US006273182B1

(12) United States Patent
Pautler et al.

(10) Patent No.: US 6,273,182 B1
(45) Date of Patent: Aug. 14, 2001

(54) HEAT EXCHANGER MOUNTING

(75) Inventors: Donald Robert Pautler, Getzville; Ralph John Honey, Randolph; Julie A. Pinger, Williamsville, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/579,261

(22) Filed: May 19, 2000

(51) Int. Cl.[7] ..... F28F 9/00
(52) U.S. Cl. ..... 165/67; 165/140; 180/68.4
(58) Field of Search ..... 165/67, 140; 180/68.4

(56) References Cited

U.S. PATENT DOCUMENTS 3,229,760 * 1/1966 Hurter et al. ..... 165/134.1
4,531,574 * 7/1985 Hoch ..... 165/67
5,139,080 8/1992 Bolton et al. .
5,219,016 6/1993 Bolton et al. .
5,355,941 10/1994 Blankenberger et al. .
5,566,748 * 10/1996 Christensen ..... 165/67
5,657,817 * 8/1997 Heine et al. ..... 165/67
5,829,133 11/1998 Joshi et al. .
5,996,684 * 12/1999 Clifton et al. ..... 165/67
6,158,500 * 12/2000 Heine ..... 165/67

* cited by examiner

*Primary Examiner*—Leonard Leo
(74) *Attorney, Agent, or Firm*—Patrick M. Griffin

(57) ABSTRACT

A mounting means for an automotive condenser (16) includes a pair of aligned through holes (24) at the upper ends of a pair of manifolds (20), which are pierced outboard of upper end plugs (22). The lower ends of the manifolds (20) are unmodified. The tanks (14) of a radiator (10) include a pair of mounting features (30, 32) spaced apart by substantially the end to end length of the manifolds (20). One pair of mounting features (30) fits closely within the lower ends of the manifolds (20), while the other pair (32) fits closely within the aligned through holes (24) at the upper ends.

4 Claims, 3 Drawing Sheets

HEAT EXCHANGER MOUNTING

TECHNICAL FIELD

This invention relates to heat exchangers in general, and specifically to an improved means for mounting a vehicle air conditioning system condenser.

BACKGROUND OF THE INVENTION

Vehicle air conditioning system condensers are mounted in front of the engine cooling radiator and just behind the vehicle body grill. Typically, the radiator is mounted directly to the vehicle body, and the smaller, lighter condenser is mounted to the front of the radiator. The molded plastic radiator tanks are a convenient location in which to integrally mold part of a condenser mounting system, such a hooks or pockets to hold separate fasteners. The other part of the condenser mounting has generally comprised brackets of various sorts, either integrally extruded with the tank, or separate. The mounting brackets may fit down into hooks molded into the tanks, or be attached with threaded fasteners to fasteners held in pockets molded into the tank, or a combination of the two. Typical examples of such mounting schemes may be seen in U.S. Pat. No. 5,219,016 and U.S. Pat. No. 5,139,080. While these provide solid, secure mountings, the brackets represent an additional expense and material, whether integrally extruded or separate.

With newer condenser manifold designs, which are basically small diameter cylinders of one or two piece construction, it is more difficult to integrally extrude or separately attach mounting brackets, than with the larger, flat sided manifolds. Mounting mechanisms have been proposed that are better suited to such smaller, cylindrical shapes. An example can be seen in U.S. Pat. No. 5,355,941, where a purpose built lower plug is stamped with an integral depending flange that fits into its own resilient mounting pad. Another example may be seen in U.S. Pat. No. 5,829,133, in which the lower plug is eliminated in favor of an integrally formed lower pin, which, in turn, can fit into its own resilient mounting pad. These two designs are best suited for mounting the condenser independent from the radiator, rather than to the front of the radiator tanks. They also require some deviation from the standard cylindrical manifold design, which is basically a simple tube plugged at each end with a recessed end plug.

SUMMARY OF THE INVENTION

The subject invention provides a means for mounting a condenser to a radiator which involves essentially no deviation from the standard condenser manifold design, and which incorporates mounting provisions on the radiator tanks that are as easy to provide as current designs.

In a preferred embodiment disclosed, a condenser has tubular manifolds closed at each end by recessed end plugs, leaving a short length of manifold wall at each end, outboard of the plug, which is empty and unencumbered with any other structure. At one end of each of the manifolds, a through hole is drilled or punched through the unencumbered length of manifold wall.

On the radiator tanks, two opposed mounting features are provided, separated by the basic length of the condenser manifolds. At one end, a short platform stands out from the tank wall, and includes a boss that fits closely within the unencumbered length of manifold wall at one end of the condenser manifold. At the other end, a mounting peg stands out from the radiator tank, long enough to fit through the through hole with a short length protruding. The condenser is mounted by setting one end of each condenser manifold onto the platform protrusions, and then swinging the other ends inward to bring the mounting peg through the through holes. Then, a suitable fastener is placed over the peg. Both ends of the condenser manifolds are thereby held securely to the radiator tanks.

BRIEF DESCRIPTION OF THE DRAWINGS

These and other features of the drawings will appear from the following written description, and from the drawings, in which.

DESCRIPTION OF THE PREFERRED EMBODIMENT

Figure 1:
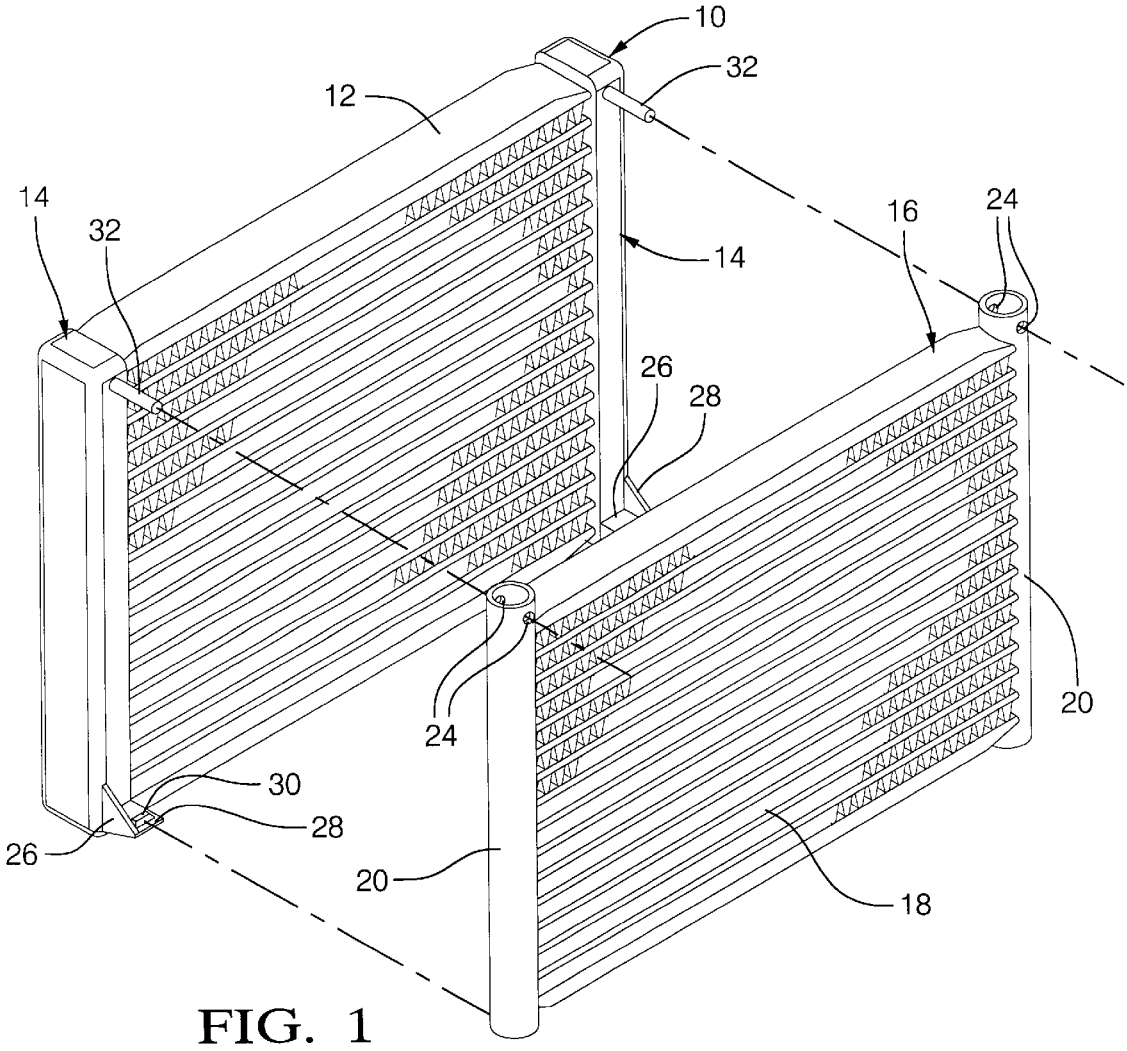
FIG. 1 is a perspective view of a radiator and condenser according to the subject invention, disassembled.

Referring first to FIG. 1, a radiator, indicated generally at 10, comprises a central tube and fin core 12 bounded by opposed, molded plastic tanks 14. Being molded plastic, the tanks 14 are good candidates for the integral molding of additional structural features, especially features related to the physical mounting of the radiator 10 itself, or additional components. Typically, the radiator 10 is securely fixed between upper and lower cross rails of a vehicle body, not illustrated, and can provide a good, solid foundation for the installation of other components. A conventional fan shroud and fan can be fixed to the back of the radiator tanks 14, pulling outside air through the vehicle grill and through the radiator 10. Fixed to the front of the radiator tanks 14 is a condenser 16, which has a basic configuration similar to the radiator 10. That is, a similar sized central tube and fin core 18 is bounded by a pair of manifolds 20. Once condenser 16 is mounted to the front of the radiator tanks 14, air is drawn first through the condenser core 18 before reaching the radiator core 12, which runs at a higher temperature. Being higher pressure, however, the manifolds 20 are manufactured of metal, typically aluminum tanks, and it is not a simple matter to provide integral mounting provisions, as it is with molded plastic. More detail on both the radiator tanks 14 and condenser manifolds 20 is given below.

Figure 2:
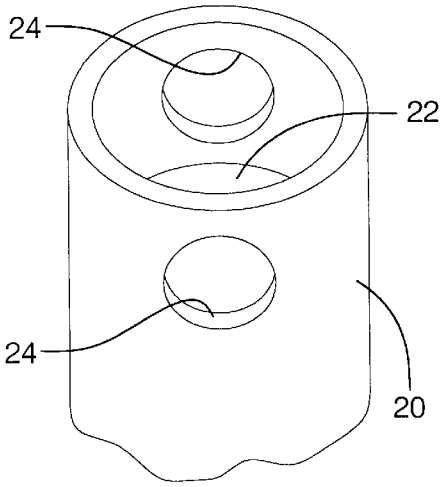
FIG. 2 is a perspective view of one end of a condenser manifold.
Figure 3:
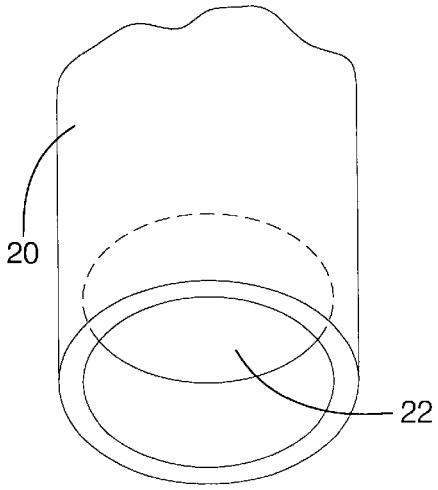
FIG. 3 is a perspective view of the other end of a condenser manifold.

Referring next to FIGS. 2 and 3, each manifold 20 is basically tubular, consisting of an outer wall closed at each end by a recessed end plug 22. The end to end or axial length of each manifold (20) is predetermined the heat exchanger area needed, and each manifold's end width (or diameter in the cylindrical case) is predetermined by the depth of the core 18. The tube may actually be comprised of two pieces brazed together, or of a single tube, and the shape, in cross section, need not be perfectly round, even though that comprises the most efficient pressure vessel. In any case, the end plug 22 is typically recessed far enough to leave at least a short length of manifold wall unencumbered, and it may easily be recessed farther to leave an even deeper empty end volume, if desired, with no change in basic tooling or construction. This otherwise unused, empty end volume is put to good use in the scheme of the invention, with minimal change to the basic construction. At one end, preferably the upper end, of each manifold 20, the outer wall is pierced by an aligned pair of through holes 24, aligned generally perpendicular to the length axis of the manifold (20). The through holes 24, being outboard of the plug 22, do nothing to disturb the function of the manifold 20, and have a diameter (or width) sufficiently less than the end width of the manifolds (20) so as not to overly weaken the wall of the manifold (20). The empty end of each manifold (20) is basically a residue of the construction technique, which is otherwise unutilized.

Figure 4:
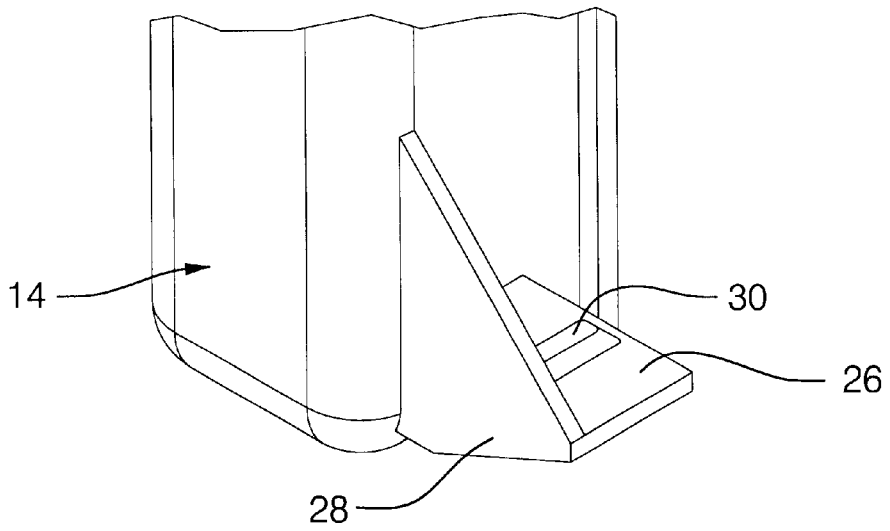
FIG. 4 is a perspective view of one end of a radiator tank, showing a mounting platform and protrusion.
Figure 5:
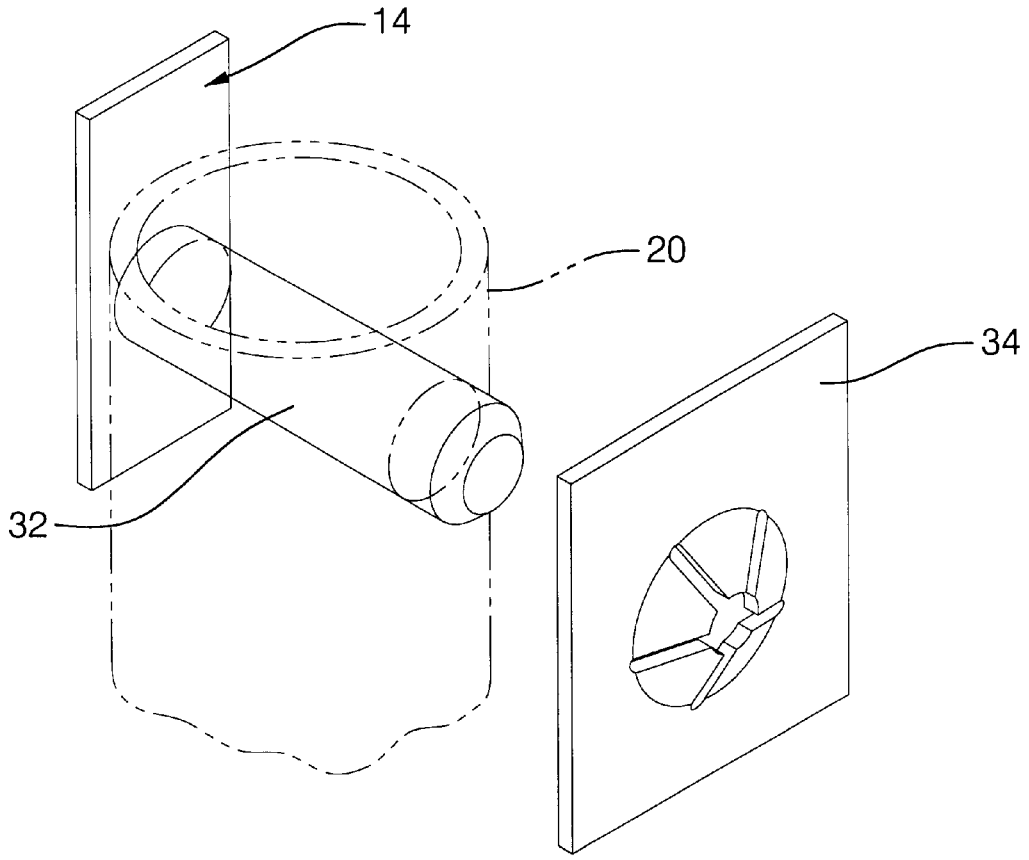
FIG. 5 is a perspective view of the other end of a radiator tank, showing a mounting peg and fastener disassembled.

Referring next to FIGS. 4 and 5, the mounting features integrally molded to the radiator tanks 14 are described in detail. At one end of each tank 14, preferably the lower end, a platform 26 stands out from the outer tank surface, at least somewhat farther than the predetermined end width of the manifold (20). The platform 26 is strengthened by a side wall 28. Molded to the platform 26 is an upstanding protrusion 30, preferably in a form which, which, like the truncated triangle or pyramid shown, is narrower at its top than the inside wall diameter or width of the empty end portion of manifold 20, and slightly wider than that at its base. Above the platform 26, a cylindrical mounting peg 32 stands out substantially perpendicular to the outer surface of tank 14, separated from platform 26 by a distance generally equal to the end to end length of manifold 20. Specifically, mounting peg 32 is spaced from platform 26 by a distance just sufficient to allow peg 32 to pass through the aligned manifold through holes 24 when the opposite end of manifold 20 is resting on platform 26. In addition, peg 32 is substantially equal in diameter (or width) to the diameter (or width) of the through holes 24, allowing for a close fit. Peg 32 is also sufficiently longer than the diameter (or width) of the manifold 20 to allow a fastener 34 to be pushed over it after it has passed through the through holes 24. The integral molding of these mounting features to the plastic tanks 14 would actually be simpler than conventional hooks or fastener pockets, since they have simpler and less convoluted shapes. The relative dimensions and orientations of the radiator tank mounting features just described allow condenser 16 to be mounted as described next.

Figure 6:
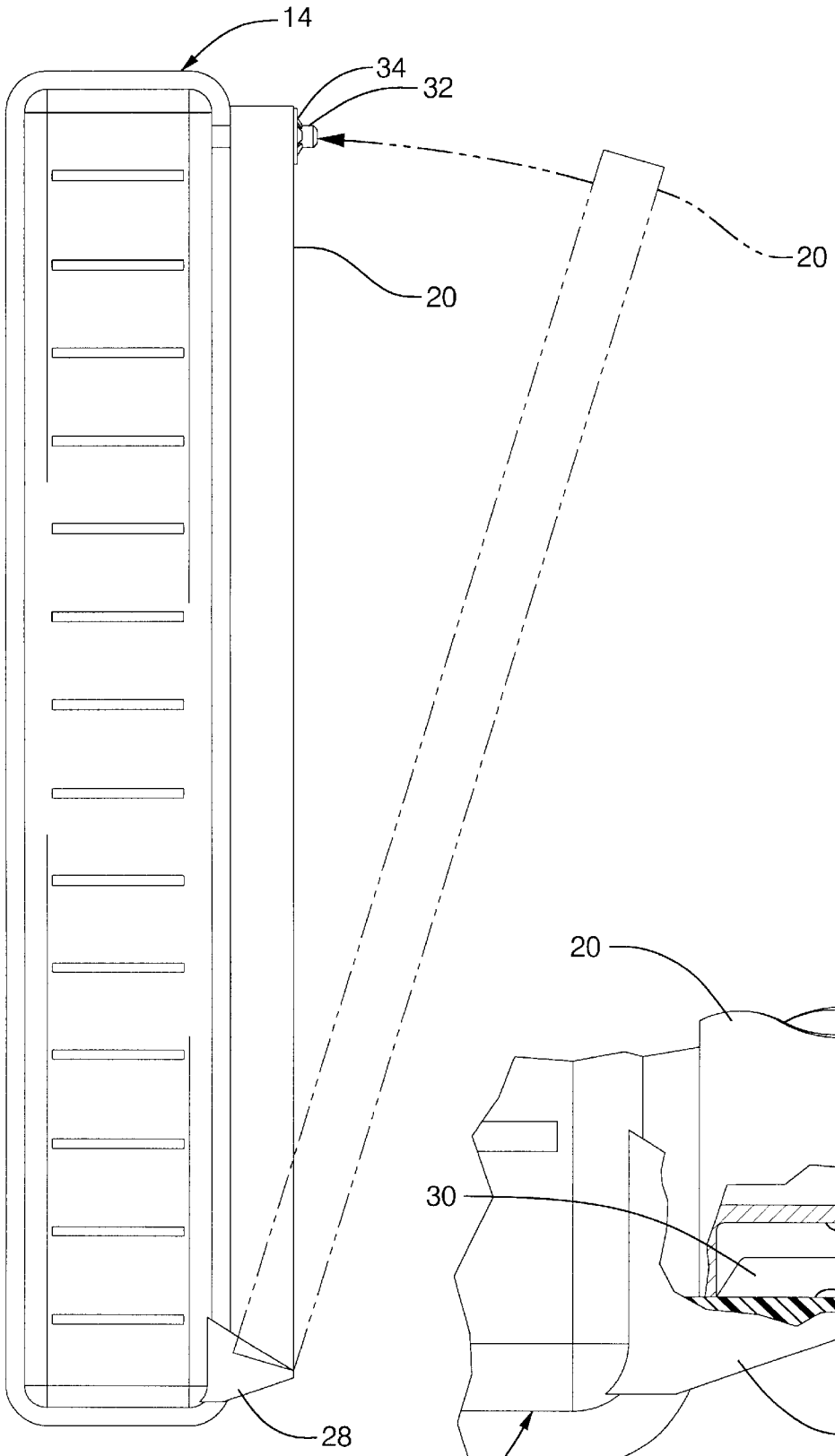
FIG. 6 is a side view showing a condenser in the process of being mounted.
Figure 7:
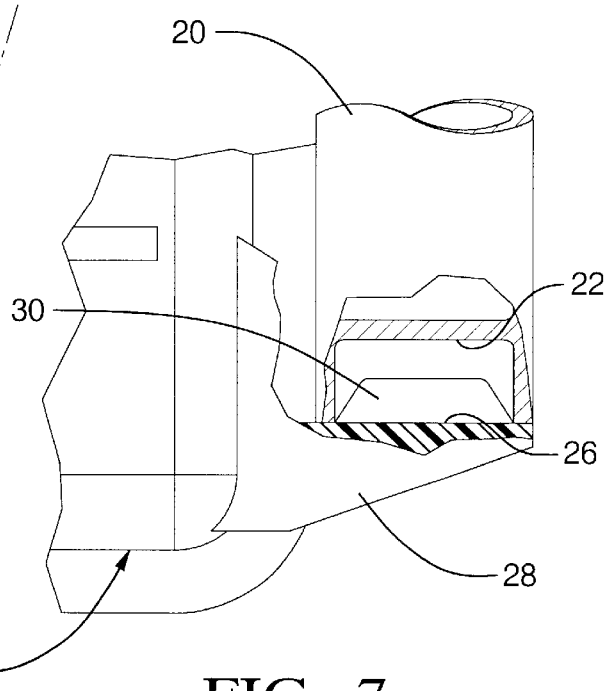
FIG. 7 is an enlarged, partially broken away view of the lower end of a radiator tank and condenser manifold assembled.

Referring next to FIGS. 6 and 7, condenser 16 is mounted by holding it an orientation where its upper ends are tilted away from the plane of radiator 10 and then setting the empty bottom ends of the manifolds 20 over the protrusions 30, pushing down firmly enough to wedge the protrusions 30 in place. The relative dimensions noted above create a snug, rattle free insertion, and the plug 22 sits inboard of the lower edge of manifold 20 far enough to provide ample room for the protrusion 30 to fit. Then, the upper ends of the manifolds 20 are swung inwardly toward the radiator tanks 14 until the mounting pegs 32 pass through the through holes 24. Again, the relative dimensions noted above create a snug fit. Finally, the fasteners 34 are pushed (or threaded, or otherwise fixed) over the pegs 32 and pushed firmly into place to retain the upper ends of the manifolds 20 closely against the outer wall surfaces of the radiator tanks 14. If desired, a resilient washer could be placed over the pegs 32 before attachment, to cushion the engagement. The end result is a secure, rattle free mounting of the condenser 16, with a very simple motion, and very few fastening components, beyond the basic tanks 14 and manifolds 20 themselves. No significant modification to the manifolds 20 themselves is needed, such as brackets or extended end plugs. The space outboard of the end plugs 22 is, as noted above, available and empty, as a result of the basic manifold construction used. Only the simple through holes 24 need be added, outboard of one of the end plugs 22.

Variations in the disclosed embodiment could be made. "Radiator" should be broadly construed to include not just plastic tanks, but equivalent structures such as a front end module to which, conceivably, both a radiator and condenser could be mounted. The pegs 32 and platforms 26 could be reversed, or, theoretically, the entire system could be turned ninety degrees, with one tank 14 having both platforms 26, and the other having both pegs 32. Other shapes could be given to the protrusion 30, so long as it fit snugly within the manifold 20's empty end, and the through holes 24 and pegs 32 could have a different, but still closely matching, shape. Conceivably, the pegs 32 could be made to snap fit through the holes 24, and thereby retain the condenser 16 without a separate fastener. The manifolds could have a shape other than cylindrical, but the system disclosed is particularly useful in that context, since it is more difficult to attach separate mounting brackets to a cylindrical shape. Therefore, it will be understood that it is not intended to limit the invention to just the embodiment disclosed.

What is claimed is:

1. A mounting means for attaching a condenser (16) having generally parallel, spaced, tubular manifolds (20), each of which manifolds 20 has a predetermined end to end length and a predetermined end width and is closed at each end by a recessed end plug (22), to a radiator (10 having a pair of generally parallel, spaced tanks (14), characterized in that;

each manifold (20) has, at one end, a pair of aligned through holes (24) oriented generally perpendicular to the manifold length, said radiator tanks (14) include two spaced pairs of mounting features (26,32), which are separated by substantially the length of said tubular manifolds, one pair of which (26) includes protrusions (30) which fit closely into the ends of said manifolds (20) that do not have the through holes (24), and the other pair of which (32) fit closely within the through holes (24), whereby said condenser (16) can be mounted to said radiator (10) by holding the condenser (16) in an orientation tilted away from the radiator (10), placing the ends of the manifolds (20) opposed to the ends containing the through holes (24) closely over the protrusions (30) and then swinging the condenser (16) toward the radiator (10) until the mounting features (32) pass through the through holes (24).

2. A mounting means according to claim 1, further characterized in that said protrusions (30) fit closely within the lower ends of said manifolds (20) and said mounting pegs (32) fit closely within through holes (24) located in the upper ends of said manifolds (20).

3. A mounting means according to claim 2, further characterized in that said manifolds (20) are substantially cylindrical, said through holes (24) are substantially circular, and said mounting pegs (32) are substantially cylindrical.

4. A mounting means according to claim 3, further characterized in that said mounting pegs are longer than the diameter of said manifolds (20) and separate fasteners (34) are fixed to said mounting pegs retain said manifolds (20) thereto.

* * * * *